United States Patent [19]

Veil

[11] 4,316,372

[45] Feb. 23, 1982

[54] PROTECTIVE DEVICE FOR A DRAWING PRESS

[75] Inventor: Martin Veil, Göppingen-Faurndau, Fed. Rep. of Germany

[73] Assignee: L. Schuler GmbH, Göppingen-Faurndau, Fed. Rep. of Germany

[21] Appl. No.: 32,258

[22] Filed: Apr. 23, 1979

[30] Foreign Application Priority Data

Apr. 22, 1978 [DE] Fed. Rep. of Germany ..... 2817787

[51] Int. Cl.[3] ..... B21B 33/00

[52] U.S. Cl. ..... 72/4; 72/9; 72/12; 83/63

[58] Field of Search ..... 72/3, 4, 9, 12; 192/125 A; 307/116; 83/61, 63

[56] References Cited

U.S. PATENT DOCUMENTS 3,319,087 5/1967 Wintriss ..... 192/125 A X 3,930,248 12/1975 Keller ..... 307/116

3,979,980 9/1976 Biester et al. ..... 83/61 X

FOREIGN PATENT DOCUMENTS 842578 5/1970 Canada .

*Primary Examiner*—Francis S. Husar

*Assistant Examiner*—C. J. Arbes

*Attorney, Agent, or Firm*—Craig and Antonelli

[57] ABSTRACT

A protective arrangement for a drawing press which includes a detector arrangement for detecting at least one of a presence of a workpiece, a semi-finished workpiece, and a correct workpiece feed whereby the drawing press is immobilized or shut down in the event the detector arrangement detects a fault. The detector arrangement is adapted to detect contours of a workpiece which have been drawn by the drawing press and is disposed downstream of a drawing station of the drawing press.

2 Claims, 2 Drawing Figures

PROTECTIVE DEVICE FOR A DRAWING PRESS

Figure 2:
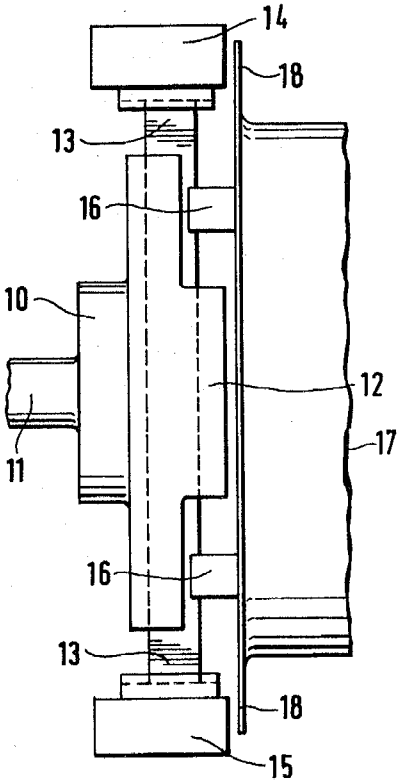

The present invention relates to a protection device and, more particularly, to a protection device for a drawing press which includes a detector means for detecting at least one of a semi-finished product, a presence of a workpiece, and/or a correct workpiece feed with the drawing press being immobilized in the event of a fault being established by the detector means.

Protective or monitoring devices for presses and, in particular, transfer presses, are proposed in Offenlegungsschrifts Nos. 22 23 071, 24 48 939, 25 37 163, see U.S. Pat. No. 3,979,980 issued Sept. 14, 1976, and 26 24 911, wherein detector means are provided which are adapted to detect a feeding of a semi-finished product, a double plate check, a feed or a transport of the workpiece or merely the presence of a workpiece in, for example, a tool space of the presses. The detector means are connected with a suitable control means which effect a shutdown of the press upon the detector means establishing the existence of a fault thereby minimizing if not avoiding any damage to the press and/or tools.

However, in practice, it has been found that protective devices of the aforementioned proposed type do not operate reliably enough, particularly in case of drawing presses in a boundary zone, since only the presence or correct transporting or feeding of a workpiece and not the nature of the workpiece can be detected. Consequently, faultily drawn workpieces, commonly referred to as "bottom ripped" may be properly ejected from a drawing tool and conveyed, for example, to a calibrating and/or trimming tool without the faulty workpiece being detected by the proposed detector means since the reaction of the detector means is the same for a properly drawn workpiece as for a correct workpiece feed. Thus, it follows that in the next machining stage, for example, in a trimming stage by a trimming tool, the incorrect or faulty drawn workpiece may result in damaging the trimming tool.

The aim underlying the present invention essentially resides in providing a protective arrangement for drawing presses by means of which properly transported but incorrectly drawn workpieces can be detected whereupon the drawing press is then immobilized or shut down.

According to advantageous features of the present invention, the detecting means is adapted to detect contours of a workpiece which have been drawn by the drawing press with the detecting means being disposed downstream of a drawing station.

According to further advantageous features of the present invention, the detector means is fashioned as a carrier plate having contactlessly operating adjustable switches diametrically opposite each other at right angles to a feed direction of the workpiece.

Moreover, in accordance with the present invention, the adjustable switches are disposed immediately beneath a plane of the feed of the workpiece.

Advantageously, in accordance with a still further feature of the present invention, the detector means may be exchanged with a drawing tool change.

Accordingly, it is an object of the present invention to provide a protective arrangement for drawing presses which avoids, by simple means, shortcomings and disadvantages encountered in the prior art.

Another object of the present invention resides in providing a protective arrangement for drawing presses which is simple in construction and therefore relatively inexpensive to manufacture.

A further object of the present invention resides in providing a protective arrangement for a drawing press by which faultily drawn workpieces are readily detected.

Yet another object of the present invention resides in providing a protective arrangement for drawing presses by which the drawing press is automatically shut down upon a detection of a faulty workpiece.

A still further object of the present invention resides in providing a protective arrangement for a drawing press which minimizes if not avoids damage to the press and/or working tools.

Another object of the present invention resides in providing a protective arrangement for drawing presses which functions reliably under all operating conditions.

Yet another object of the present invention resides in providing a protective arrangement for a drawing press whereby contours typical of a faultily drawn workpiece may be sensed in a simple and advantageous manner and utilized to effect a shutdown of the drawing press.

A still further object of the present invention resides in providing a protective arrangement for a drawing press which is mechanically simple in construction and which permits an easy exchange of a detector means in the event a tool of the drawing press is changed.

Figure 1:
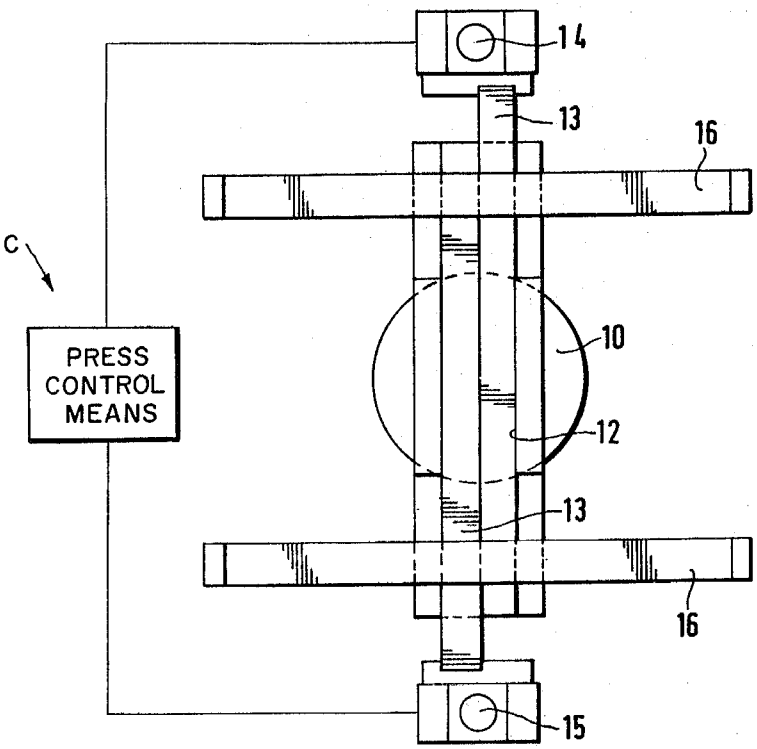

These and other objects, features, and advantages of the present invention will become more apparent from the following description when taken in connection with the accompanying drawing, which shows, for the purposes of illustration only, one embodiment in accordance with the present invention, and wherein:

FIG. 1 is a schematic top plan view of a protective arrangement for a drawing press in accordance with the present invention; and FIG. 2 is a side view of the protective arrangement of FIG. 1.

Referring now to the drawing, wherein like reference numerals are used in both views to designate like parts, and, more particularly, to FIG. 1, according to this figure, a carrier plate 10 is provided with a U-shaped guide slot 12 in which adjacently disposed sliding members 13 are adjustably guided. The sliding members 13 are provided, at diametrically opposed ends, with contactless operating switches 14, 15. Guide rails 16 are disposed at right angles to the sliding members 13 and in parallel with a direction of feed and a plane of feed of the workpieces. The guide rails 16 are mounted so as to be adjustable with respect to each other.

As shown in FIG. 2, the carrier plate 10 is disposed on a cylindrical fixing shaft 11. A schematically illustrated deep drawn workpiece 17 is provided with a drawing flange 18. The diameter of the drawing flange 18 is, in the illustrated embodiment, considered the criterion for an operation of the protective device with outer contours of the flange 18 being sensed by the contactless operating switches 14, 15.

During an operation of the drawing press, a stamped out sheet is fed to a drawing tool in a conventional manner. During the drawing process, the stamped out sheet is held by a sheet depressor (not shown) on the drawing flange 18 which diminishes under normal circumstances, its diameter not exceeding a predetermined amount in the case of the workpiece 17 which is drawn and completed without damage. In the situation of a faultily drawn workpiece 17, for example, a "bottom ripped" workpiece which is correctly ejected from a drawing tool, the diameter of the drawing flange 18 is measurably larger since, by virtue of the tearing out of the drawing flange 18 during the drawing process, virtually no further material follows on. With proposed conventional protective or monitoring devices, it would not be possible in such a situation to detect the presence of the faulty workpiece 17 but rather only if the defective workpiece 17 was not ejected from the drawing tool would the proposed protective device receive a fault signal which would then stop the drawing press.

By virtue of the protective arrangement illustrated in FIGS. 1 and 2, a reliable operation is insured and a detection of a faulty but correctly transported workpiece 17 is obtained by reason of the fact that the contour of the drawing flange 18, that is, the diameter of the flange 18, is detected during a transport phase from the drawing tool to, for example, a trimming and/or calibrating tool.

With the protective arrangement of the present invention, undamaged workpieces 17 do not trigger the protective device since the drawing flange 18 is moved between the switches 14, 15 and therefore do not cover such switches; whereas, the faulty workpieces 17 with the enlarged diameter drawing flange 18 cover the switches 14, 15 so as to trip the protective device thereby causing the drawing press to be stopped by virtue of the connection of the switches 14, 15 with a conventional press control means whereby damage to the tools and/or the drawing press is avoided.

By virtue of the constructional features of a detector means in accordance with the present invention, it is possible in a simple and advantageous manner to adjust the switches 14, 15 with regard to the contours and/or feed path of the workpiece 17. Moreover, the construction of the carrier plate 10 facilitates an easy exchange of the detector means in the event a tool change is necessary.

While I have shown and described only one embodiment in accordance with the present invention, it is understood that the same is not limited thereto, but is susceptible of numerous changes and modifications as known to one having ordinary skill in the art, and I therefore do not wish to be limited to the details shown and described herein, but intend to cover all such modifications as are encompassed by the scope of the appended claims.

The above-described contactless switches 14, 15 are constructed in a conventional manner. The ALLEN-BRADLEY Bulletin 870 contactless (proximity) switch is one example of a commercially rugged electronic unit.

I claim:

1. A protective arrangement for a drawing press comprising:

detector means for detecting a faultily drawn workpiece; and shut down means operatively connected with the detector means and the drawing press;

wherein the detector means are disposed downstream of a drawing station of the drawing press and outside of the path of travel of a correctly drawn workpiece; and wherein the detector means includes a pair of contactless switches adjustably mounted on a carrier plate means, said switches being disposed perpendicularly to the conveying direction in diametrical opposition to each other, and wherein, during conveyance of a defective workpiece, at least one of the adjustable contactless switches is tripped, whereby, in the event a faultily drawn workpiece is detected by the detector means, a shutdown of the drawing press is effected.

2. A protective arrangement according to claim 1, wherein the switches are disposed at a position immediately below a plane of feed of the drawn workpiece.

* * * * *